US010121363B2

(12) United States Patent
Lin et al.

(10) Patent No.: US 10,121,363 B2
(45) Date of Patent: Nov. 6, 2018

(54) ALARM TRIGGERING METHOD FOR SENSOR AND ELECTRONIC DEVICE USING THE SAME

(71) Applicants: LITE-ON ELECTRONICS (GUANGZHOU) LIMITED, Guangzhou (CN); Lite-On Technology Corporation, Taipei (TW)

(72) Inventors: Su-Chen Lin, Taipei (TW); Shr-Rung Lin, Taipei (TW); Chun-Yen Chen, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 15/697,455

(22) Filed: Sep. 7, 2017

(65) Prior Publication Data

US 2018/0182235 A1 Jun. 28, 2018

Related U.S. Application Data

(60) Provisional application No. 62/439,155, filed on Dec. 27, 2016.

(30) Foreign Application Priority Data

Jun. 1, 2017 (CN) ..... 2017 1 0403044

(51) Int. Cl.
*G08B 21/18* (2006.01)
*G08B 29/18* (2006.01)

(52) U.S. Cl.
CPC ..... *G08B 29/185* (2013.01); *G08B 21/182* (2013.01)

(58) Field of Classification Search
CPC ..... G08B 21/24
USPC ..... 340/571
See application file for complete search history.

(56) References Cited

U.S. PATENT DOCUMENTS

| | | | | |
|---|---|---|---|---|
| 4,636,774 | A | 1/1987 | Galvin et al. | |
| 5,309,147 | A | 5/1994 | Lee et al. | |
| 6,288,395 | B1 | 9/2001 | Kuhnly et al. | |
| 9,390,600 | B1 * | 7/2016 | Sirotkin | G08B 1/08 |
| 2004/0210155 | A1 * | 10/2004 | Takemura | A61B 5/00 600/534 |
| 2005/0127298 | A1 | 6/2005 | DiPoala | |

(Continued)

*Primary Examiner* — Santiago Garcia
(74) *Attorney, Agent, or Firm* — JCIPRNET

(57) ABSTRACT

An alarm triggering method for a sensor and an electronic device using the same are proposed. The method is applicable to an electronic device and includes the following steps. A sensor signal is received from the sensor. Whether a signal magnitude of the sensor signal satisfies a first triggering condition associated with a first determination threshold is determined. In response to the signal magnitude satisfying the first triggering condition, whether the signal magnitude satisfies a second triggering condition associated with a second determination threshold or a third triggering condition associated with a time determination threshold is further determined, where the second determination threshold is greater than the first determination threshold. When the signal magnitude satisfies the second triggering condition or the third triggering condition, the sensor is determined to be in an alarm state so as to output an alarm signal.

22 Claims, 7 Drawing Sheets

(56) References Cited

U.S. PATENT DOCUMENTS

| | | | | |
|---|---|---|---|---|
| 2009/0303069 | A1* | 12/2009 | Carl, Jr. | G08B 13/191 340/686.1 |
| 2010/0008539 | A1* | 1/2010 | Johnson | F41H 11/00 382/103 |
| 2012/0293076 | A1* | 11/2012 | Drake | F21V 23/0442 315/152 |
| 2013/0300566 | A1* | 11/2013 | Kumfer | H02H 5/12 340/686.6 |
| 2015/0013958 | A1* | 1/2015 | Kubo | F24F 11/0012 165/237 |
| 2015/0296323 | A1* | 10/2015 | Wu | H04W 4/70 455/414.1 |
| 2016/0034043 | A1* | 2/2016 | Le Grand | G06F 1/3265 345/156 |
| 2016/0084803 | A1* | 3/2016 | Takamine | E04C 3/26 73/587 |
| 2016/0125721 | A1* | 5/2016 | Hughes | G08B 21/24 340/539.13 |
| 2016/0187118 | A1* | 6/2016 | Modi | G01B 7/14 340/815.45 |
| 2017/0040843 | A1* | 2/2017 | Asanuma | H02J 7/025 |
| 2017/0074833 | A1* | 3/2017 | Takamine | G01N 29/14 |
| 2017/0254703 | A1* | 9/2017 | Purohit | G01J 5/0025 |

* cited by examiner

ALARM TRIGGERING METHOD FOR SENSOR AND ELECTRONIC DEVICE USING THE SAME

CROSS-REFERENCE TO RELATED APPLICATION

This application claims the priority benefits of U.S. provisional application Ser. No. 62/439,155, filed on Dec. 27, 2016 and China application serial no. 201710403044.2, filed on Jun. 1, 2017. The entirety of each of the above-mentioned patent applications is hereby incorporated by reference herein and made a part of this specification.

TECHNICAL FIELD

The disclosure relates to an alarm triggering method and an electronic device using the same, in particular to, an alarm triggering method for a sensor and an electronic device using the same.

BACKGROUND

An infrared motion sensor (also known as "a human infrared sensor") is a passive infrared sensor (PIR) that absorbs an infrared radiation signal from an external object through a Fresnel lens on the surface of the sensor itself and generates an analog signal with positive and negative oscillations. The existing technique is to sample such analog signal so as to convert the infrared radiation signal to an infrared radiation magnitude and then compare such magnitude with a preset threshold to determine whether any object is nearby.

However, infrared radiation magnitudes of humans, animals, and other objects would be different, and infrared radiation magnitudes measured under different ambient conditions would also be different. Hence, a single fixed threshold and a single determination approach used in the existing technique would cause false alarms due to the above differentiations.

SUMMARY OF THE DISCLOSURE

Accordingly, an alarm triggering method and an electronic device using the same are proposed in the disclosure, where multiple thresholds are used for determining whether a signal magnitude of the sensor satisfies an alarm triggering condition so as to reduce chances of false alarm.

According to one of the exemplary embodiments, the method is applicable to an electronic device and includes the following steps. A sensor signal is received from the sensor. Whether a signal magnitude of the sensor signal satisfies a first triggering condition is determined, where the first triggering condition is associated with a first determination threshold. When the signal magnitude satisfies the first triggering condition, whether the signal magnitude satisfies a second triggering condition or a third triggering condition is further determined, where the second triggering condition is associated with a second determination threshold, the second determination threshold is greater than the first determination threshold, and the third triggering condition is associated with a time determination threshold. When the signal magnitude satisfies the second triggering condition or the third triggering condition, the sensor is determined to be in an alarm state so as to output an alarm signal.

According to one of the exemplary embodiments, the electronic device includes an analog-to-digital converter, a memory, and a processor, where the processor is coupled to the analog-to-digital converter and the memory. The analog-to-digital converter is configured to receive a sensor signal from a sensor and convert the sensor signal to a signal magnitude. The memory is configured to store data. The processor is configured to determine whether a signal magnitude of the sensor signal satisfies a first triggering condition, determine whether the signal magnitude satisfies a second triggering condition or a third triggering condition when the signal magnitude satisfies the first triggering condition, and determine that the sensor is in an alarm state so as to output an alarm signal when the signal magnitude satisfies the second triggering condition or the third triggering condition, where the first triggering condition is associated with a first determination threshold, the second triggering condition is associated with a second determination threshold, the second determination threshold is greater than the first determination threshold, and the third triggering condition is associated with a time determination threshold.

In order to make the aforementioned features and advantages of the present disclosure comprehensible, preferred embodiments accompanied with figures are described in detail below. It is to be understood that both the foregoing general description and the following detailed description are exemplary, and are intended to provide further explanation of the disclosure as claimed.

It should be understood, however, that this summary may not contain all of the aspect and embodiments of the present disclosure and is therefore not meant to be limiting or restrictive in any manner. Also the present disclosure would include improvements and modifications which are obvious to one skilled in the art.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

Figure 1:
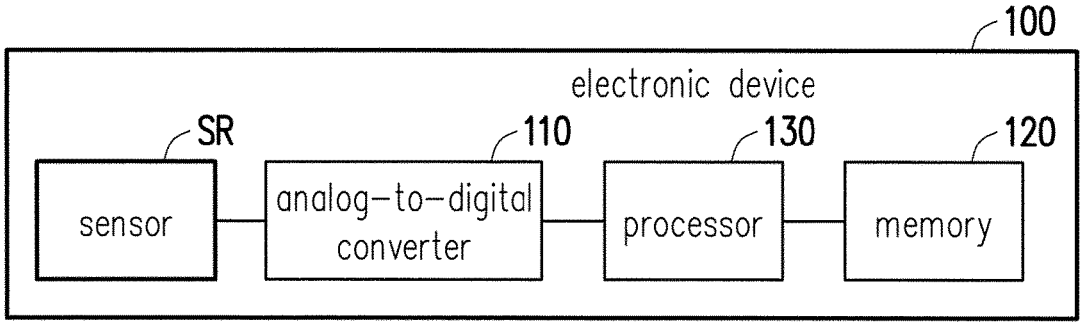
FIG. 1 illustrates a schematic block diagram of an electronic device in accordance with one of the exemplary embodiments of the disclosure.

To make the above features and advantages of the application more comprehensible, several embodiments accompanied with drawings are described in detail as follows.

DESCRIPTION OF THE EMBODIMENTS

Some embodiments of the disclosure will now be described more fully hereinafter with reference to the accompanying drawings, in which some, but not all embodiments of the application are shown. Indeed, various embodiments of the disclosure may be embodied in many different forms and should not be construed as limited to the embodiments set forth herein; rather, these embodiments are provided so that this disclosure will satisfy applicable legal requirements. Like reference numerals refer to like elements throughout.

FIG. 1 illustrates a schematic diagram of an electronic device in accordance with one of the exemplary embodiments of the disclosure. It should, however, be noted that this is merely an illustrative example and the disclosure is not limited in this regard. All components of the electronic device and their configurations are first introduced in FIG. 1. The detailed functionalities of the components are disclosed along with FIG. 2.

Referring to FIG. 1, an electronic device 100 in the present exemplary embodiment would include a sensor SR, an analog-to-digital converter 110, a memory 120, and a processor 130, where the processor 130 would be coupled to the analog-to-digital converter 110 and the memory. Yet in another exemplary embodiment, the electronic device 100 may be a computer system or device capable of signal and data processing and may be externally connected to the sensor SR. Yet still in another exemplary embodiment, the electronic device 100 and the sensor SR may be integrated into a single device. The sensor SR may be a device, such as a light sensor, an audio sensor, an infrared (IR) sensor, a temperature sensor, a humidity sensor, a pressure sensor, an air sensor, and an ultraviolet (UV) sensor, configured to detect ambient information.

The analog-to-digital converter 110 would be configured to convert a consecutive analog signal received from the sensor SR to a discrete digital signal.

The memory 120 would be configured to store data and programming code and may be one or a combination of a stationary or mobile random access memory (RAM), a read-only memory (ROM), a flash memory, a hard drive, other similar devices or integrated circuits.

The processor 130 would be configured to control the operation among the components of the electronic device 100 and may be a central processing unit (CPU) or other programmable devices for general purpose or special purpose such as a microprocessor, a microcontroller (MCU), a programmable logic device (PLD), a digital signal processor (DSP), a field-programmable gate array (FPGA, an application specific integrated circuit (ASIC), other similar devices or a combination of aforementioned devices.

Detailed steps of how the electronic device 100 performs the proposed alarm triggering method for the sensor SR would be illustrated along with each component hereafter.

Figure 2:
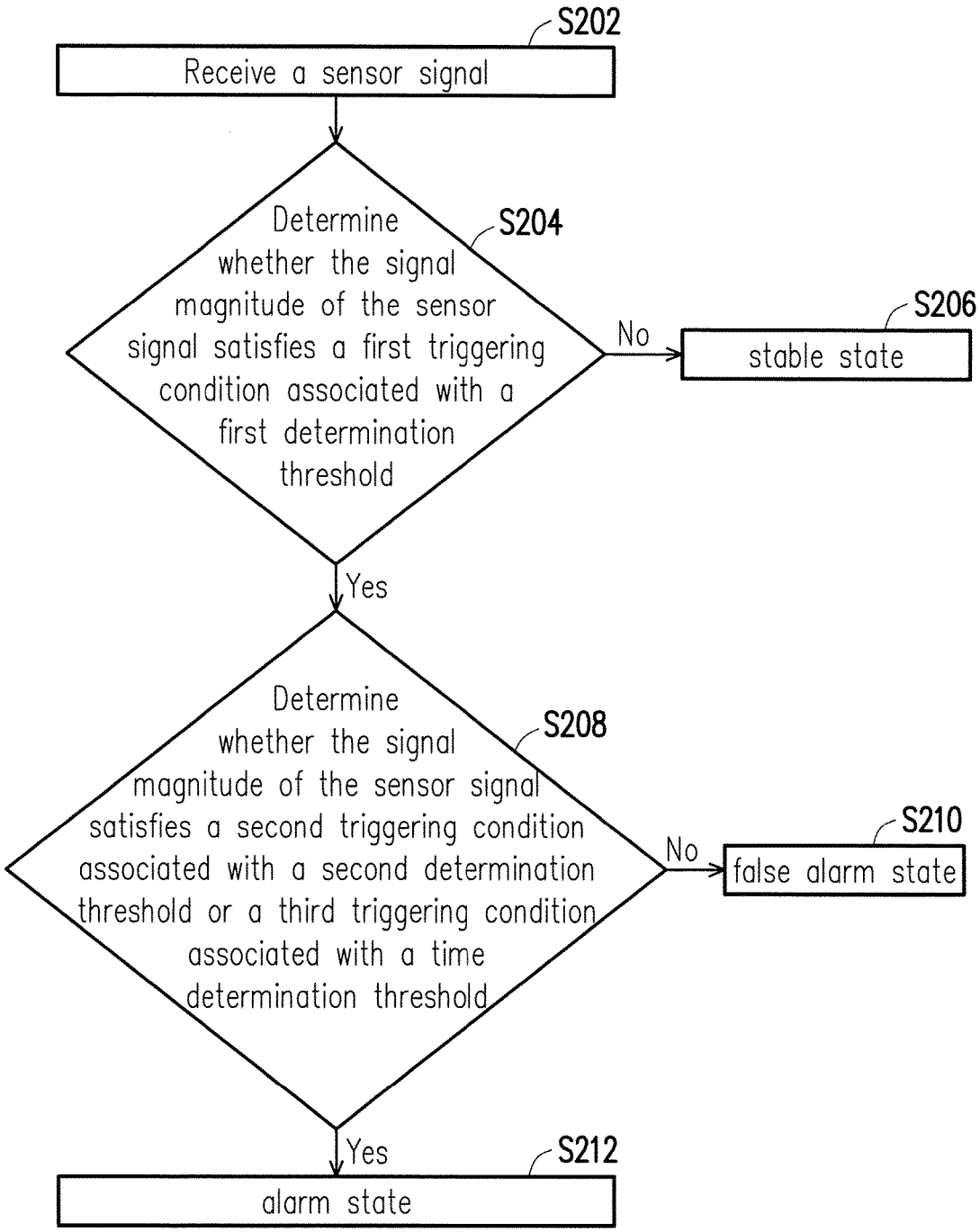
FIG. 2 illustrates an alarm triggering method for a sensor in accordance with one of the exemplary embodiments of the disclosure.

FIG. 2 illustrates an alarm triggering method for a sensor in accordance with one of the exemplary embodiments of the disclosure. In the present exemplar embodiment, two different detection thresholds and a single time determination threshold would be used to reduce false alarms, where all thresholds have been pre-stored in the memory 120.

Referring to both FIG. 1 and FIG. 2, the analog-to-digital converter 110 of the electronic device 100 would receive a sensor signal from the sensor SR (Step S202) and convert the sensor signal to a signal magnitude in a digital format. Next, the processor 130 would determine whether the signal magnitude of the sensor signal satisfies a first triggering condition associated with a first determination threshold (Step S204). The first triggering condition would be the signal magnitude of the sensor signal being greater than the first determination threshold. When the processor 130 determines that the signal magnitude does not satisfy the first triggering condition (i.e. the signal magnitude is less than the first determination threshold), it means that the sensor SR is in a stable state (Step S206); that is, an alarm triggering condition has not yet been satisfied.

On the other hand, when the processor 130 determines that the signal magnitude satisfies the first triggering condition (i.e. the signal magnitude exceeds the first determination threshold), the processor 130 would further determine whether the signal magnitude of the sensor signal satisfies a second triggering condition associated with a second determination threshold or a third triggering condition associated with a time determination threshold (Step S208), where the second determination threshold is greater than the first determination threshold.

To be specific, in order to prevent false alarms due to internal or external factors of the sensor SR that cause the signal magnitude to exceed the first determination threshold as slight fluctuation, the second triggering condition would be additionally set to adjust triggering sensitivity, where the second triggering condition would be the signal magnitude of the sensor signal exceeding the second determination threshold. When the processor 130 determines that the signal magnitude satisfies the second triggering condition (i.e. the signal magnitude of the sensor signal exceeds the second determination threshold), it would confirm that the sensor SR is in an alarm state (Step S212); that is, the condition to trigger the alarm is met.

It should be noted that, when the processor 130 determines that the signal magnitude does not satisfies the second triggering condition (i.e. the signal magnitude of the sensor signal falls between the first determination threshold and the second determination threshold), it would further use the third triggering condition as an auxiliary condition to determine whether such situation is a false alarm. The third triggering condition would be a consecutive time of the signal magnitude being greater than the first determination threshold exceeding the time determination threshold. When the processor 130 determines that the signal magnitude satisfies the third triggering condition (i.e. the consecutive time of the signal magnitude being greater than the first determination threshold exceeds the time determination threshold), it means that the sensor SR is in the alarm state (Step S212); that is, the condition to trigger the alarm is met.

Corollarily, when the processor 130 determines that the signal magnitude does not satisfies any of the second triggering condition and the third triggering condition (i.e. the consecutive time of the signal magnitude being greater than the first determination threshold does not exceed the time determination threshold), that is, the signal magnitude fluctuates such that it exceeds the first determination threshold only for a short moment and immediately drops below the first determination threshold, it means that the sensor SR is in a false alarm state (Step S210); that is, the condition to trigger the alarm has not been met.

In the present exemplary embodiment, when the processor 130 determines that the sensor SR is in the alarm state, it would output a warning signal. The processor 130 may be connected to, for example, an output device (not shown) such as a speaker, a screen, an indicator light so as to the warning signal such as sound, voice, texts, icons, light, and so forth. The electronic device 100 may be wiredly or wirelessly connected to another device, and the warning signal may be transmitted to such device as a triggering signal for operation.

For a better comprehension of the flows in FIG. 2, the sensor SR would be embodied by a PIR sensor herein for illustrative purposes.

Figure 3:
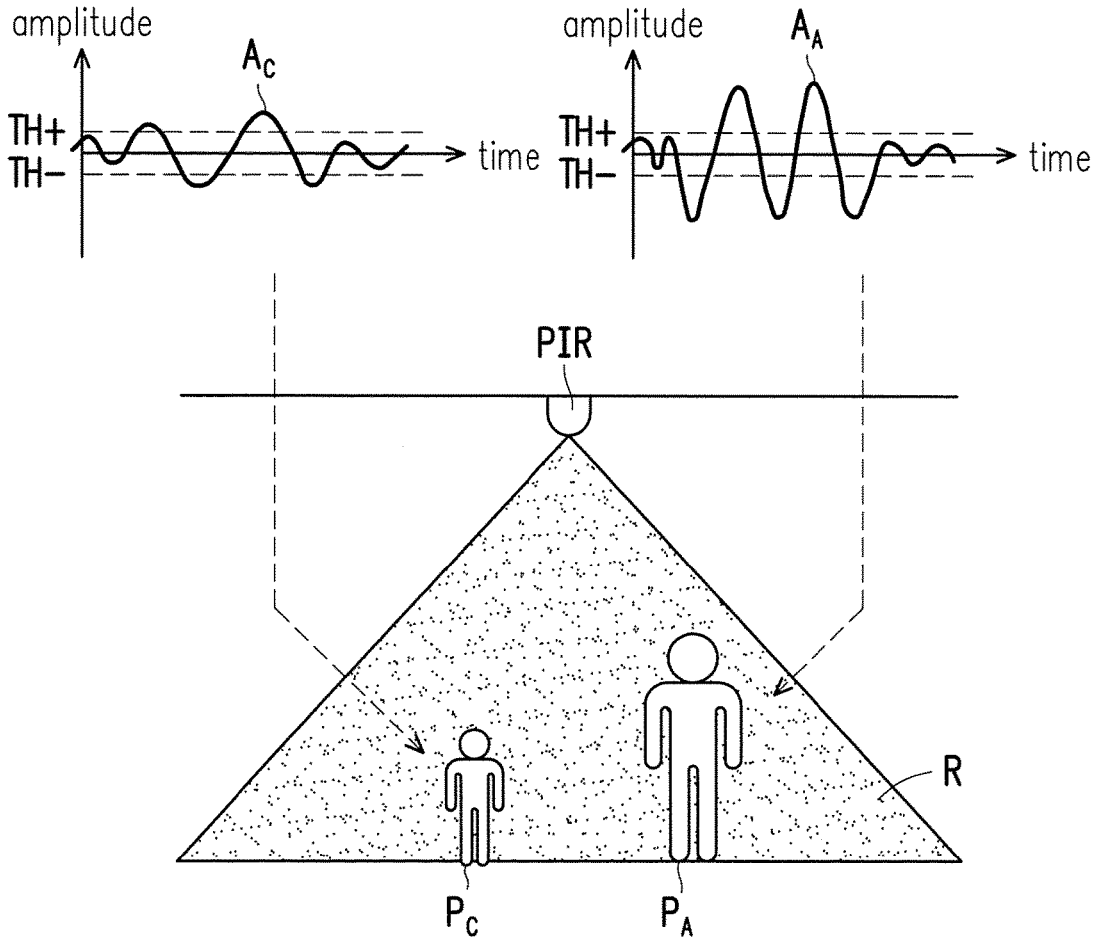
FIG. 3 illustrates a scenario schematic diagram of a conventional alarm triggering method.
Figure 4A:
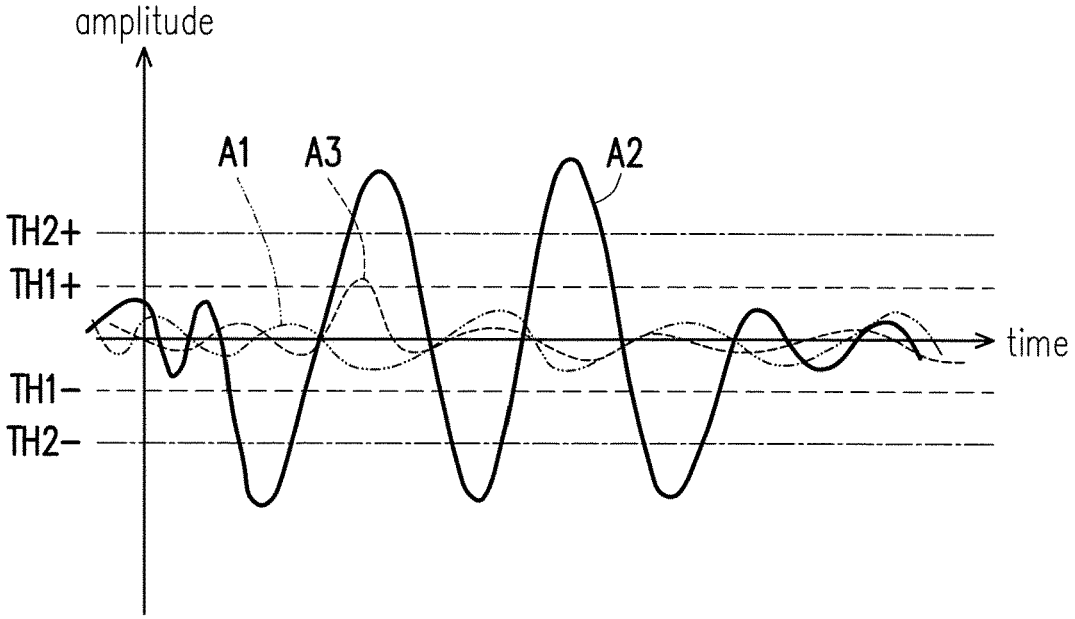
FIG. 4A-FIG. 4B illustrate schematic diagrams of an alarm triggering method for a sensor in accordance with one of the exemplary embodiments of the disclosure.
Figure 4B:
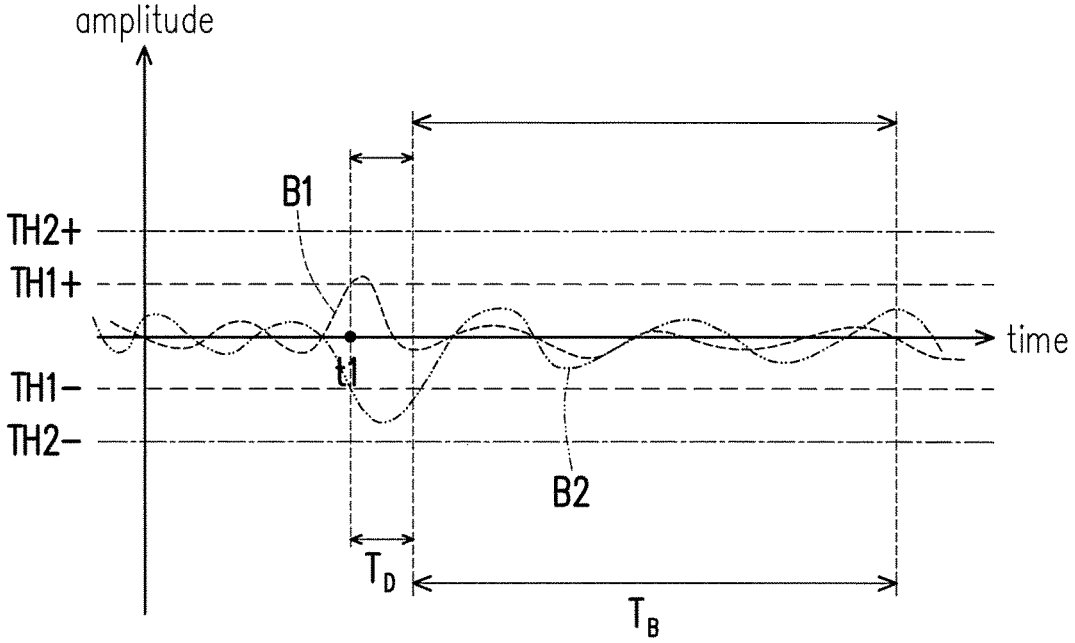

FIG. 3 illustrates a scenario schematic diagram of a conventional alarm triggering method. FIG. 4A-FIG. 4B illustrate schematic diagrams of an alarm triggering method for a sensor in accordance with one of the exemplary embodiments of the disclosure, where the sensor would be a PIR sensor.

Referring to FIG. 3, a child PC or an adult PA would be detected with different IR radiation values by a PIR sensor within a same detection range R and would respectively correspond to a signal amplitude Ac and a signal amplitude $A_A$ within a same time period. Hence, a single set of fixed thresholds TH (including TH+ and TH−) would provide no flexibility in triggering.

Referring to FIG. 4A, with the same detection environment as in FIG. 3, assume that the electronic device 100 would use a first threshold set TH1 (including TH1+ and TH1−) and a second threshold set TH2 (including TH2+ and TH2−) to determine trigger events. The first threshold set TH1 would serve as a determination value for stable state transition. The second threshold set TH2 would serve to adjust triggering sensitivity, and thus the second threshold set TH2 would be adjusted based on different objects being detected.

The signal magnitude of the sensor SR may fall into three different intervals. The first interval of the signal magnitude would be below the first threshold set TH1, and it corresponds to the stable state in which the signal amplitude falls between TH1+ and TH1− such as a signal amplitude A1. The second interval of the signal magnitude would exceed the second threshold set TH2, and it corresponds to the alarm state in which the signal amplitude falls between TH2+ and ∞ or between TH2− and −∞ such as a signal amplitude A2. The third interval of the signal magnitude would exceed the first threshold set TH1 but not exceed the second threshold set TH2, that is, the signal amplitude falls between TH1+ and TH2+ or between TH2− and TH1− such as a signal amplitude A3. When the signal magnitude of the sensor SR is in the third interval, an additional detection delay time period would be set as a buffer period to prevent false alarm.

In detail, referring to FIG. 4B, a signal amplitude B1 would exceed the first threshold set TH1+ (yet below TH2+) at time t1 but drop back to below the first threshold set TH+ before the detection delay time period $T_D$ ends, and thus the sensor SR is in the false alarm state. On the other hand, a signal amplitude B2 would exceed the first threshold set TH1− (yet below TH2−) for over the detection delay time period $T_D$ starting from time t1, and thus the sensor SR is in the alarm state. Moreover, after the first oscillation is detected, the processor 130 would set a time period (referred to as "a blind time period $T_B$") to turn off such oscillation detection feature to prevent from repeated trigger event being detected. Hence, when the signal amplitude B1 and the signal amplitude B2 oscillate for the first time, the sensor SR would return back to the stable state after the blind time period $T_B$ ends.

Figure 5:
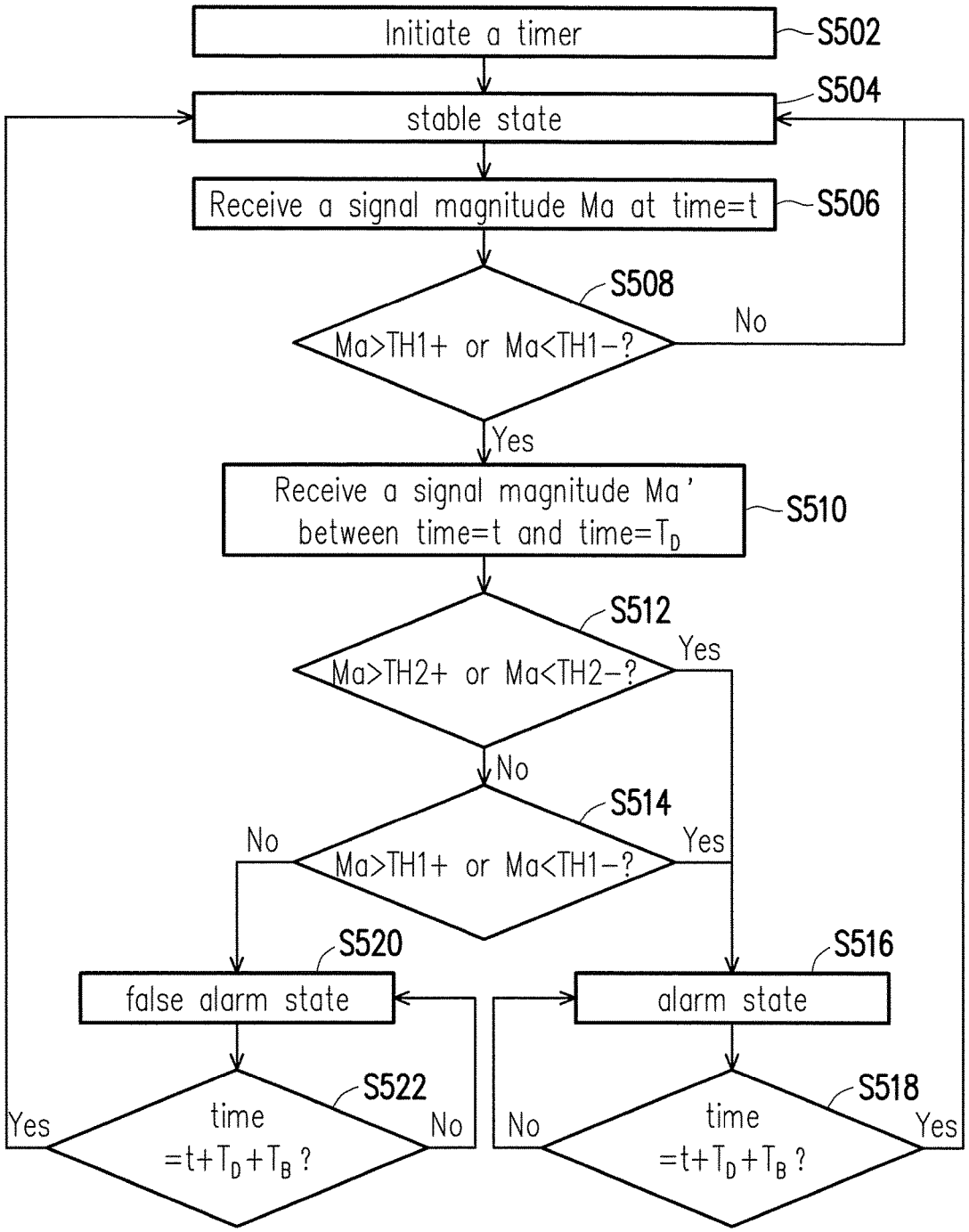
FIG. 5 illustrates an algorithm flowchart of an alarm triggering method in accordance with one of exemplary embodiments of the disclosure.

For a more detailed description, FIG. 5 illustrates an algorithm flowchart of an alarm triggering method in accordance with one of exemplary embodiments of the disclosure.

Referring to FIG. 5 along with FIG. 1, when the electronic device 100 enters a flow of the warning triggering method, the processor 130 would initiate a timer (Step S502). Before the processor 130 receives any signal magnitude, it would set the state of the sensor SR to the stable state by default (Step S504). Herein, the processor 130 would receive a signal magnitude Ma at time t (Step S06), where time t would be a current time point of the timer. Next, the processor 130 would determine whether an interval that the signal magnitude Ma falls into satisfies Ma>TH1+ or Ma<TH1− by using a first determination threshold set TH1 (Step S508). If no, it means that the signal magnitude Ma would not exceed the first determination threshold set TH1. It other words, the sensor SR would be in the stable state, and the flow would return to Step S504. The processor 130 would continue determining an interval that a signal magnitude obtained in the next time point falls into.

When the determination of Step S508 is yes, the processor 130 would further determine the state of the sensor SR according to a signal magnitude Ma' detected in a delayed time period $T_D$. Herein, the processor 130 would determine whether an interval that the signal magnitude Ma' falls into satisfies Ma'>TH2+ or Ma'<TH2− by using a second determination threshold set TH2 (Step S512).

When the determination of Step S512 is yes, the processor 130 would determine that the sensor SR is in the alarm state (Step S516). Next, a blind time period $T_B$ begins. The processor 130 would determine whether the blind time period $T_B$ ends (Step S518, i.e. whether the time reaches $t+T_D+T_B$). When the blind time $T_B$ has not ended, the processor 130 would continue determining that the sensor SR is in the alarm state (return to Step S516). When the blind time period $T_B$ ends, the processor 130 would transition the sensor SR to the stable state (return to Step S504) so as to restart the state determination process.

On the other hand, when the determination of Step S512 is no, the processor 130 would further determine whether an interval that the signal magnitude Ma' detected in the delayed time period $T_D$ falls into still satisfies Ma'>TH1+ or Ma'<TH1− (Step S514). If yes, the processor 130 would determine that the sensor SR is in the alarm state (Step S516). If no, the processor 130 would determine that the sensor SR is in the false alarm state (Step S520). Next, the blind time period $T_B$ also begins, and the processor 130 would determine whether the blind time period $T_B$ ends (Step S522, i.e. whether the time reaches $t+T_D+T_B$). When the blind time $T_B$ has not ended, the processor 130 would continue determining that the sensor SR is in the false alarm state (return to Step S520). When the blind time period $T_B$ ends, the processor 130 would transition the sensor SR to the stable state (return to Step S504) so as to restart the state determination process.

In the present exemplary embodiment, when the processor 130 determines that the sensor SR is in the alarm state, it would output a warning signal. Assume that the sensor SR is a PIR sensor for human detection. The processor 130 may be connected to, for example, a speaker that would emit warning sound when the processor 130 output the warning signal for surveillance purposes. Alternatively, the processor 130 may be connected to a light source that would emit light when the processor 130 output the warning signal for automatic control.

Figure 6:
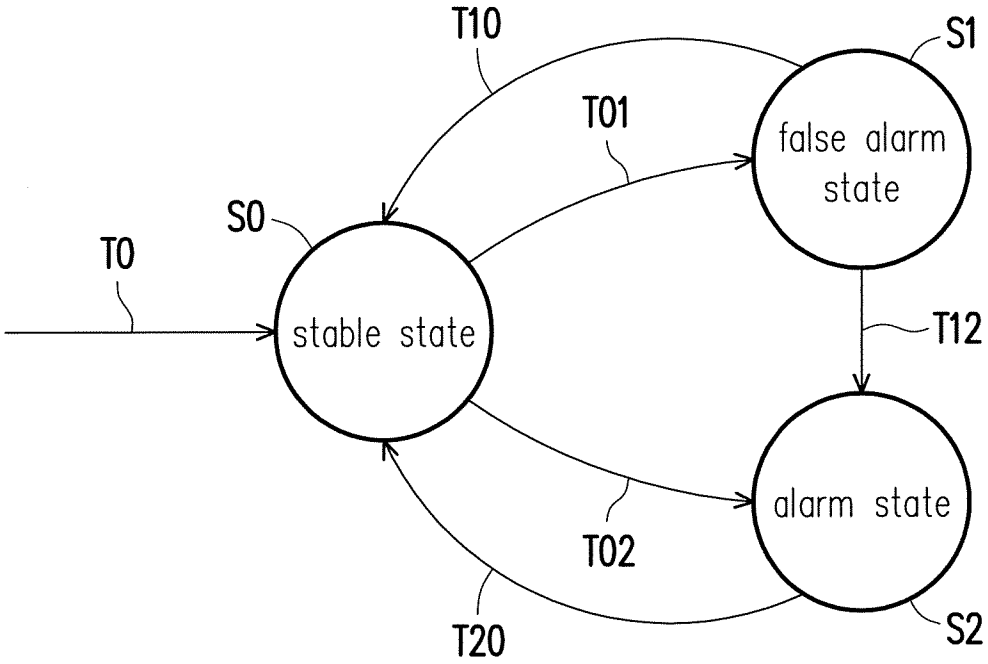
FIG. 6 illustrates a state transition diagram of a sensor in accordance with one of exemplary embodiments in the disclosure.

In terms of the sensor SR, FIG. 6 illustrates a state transition diagram of a sensor in accordance with one of exemplary embodiments in the disclosure.

Referring to FIG. 6 along with FIG. 1, the processor 130 would receive a signal magnitude S of the sensor SR, a first determination threshold TH1, a second determination threshold TH2, a current time point Time_C, an ending time point of a detection delay time period Time_D, and an ending time point of a blind time period Time_B. The sensor SR would be set to a stable state S0 by default in a state transition direction TO.

In the present exemplary embodiment, when the processor 130 determines that the signal magnitude S falls between the first determination threshold TH1 and the second determination threshold TH2 and when the ending time of the detection delay time period Time_D has not been reached (i.e. a logical expression would be "TH1<S<TH2 && Time_C<Time_D"), the sensor SR would be transitioned to a false alarm state S1 temporarily in a state transition direction T01. During this period, when the signal magnitude S drops back to below the first determination threshold TH1 (i.e. a logical expression would be "S<TH1 && Time_C<Time_D"), the sensor SR would stay in the false alarm state S1. When the processor 130 further determines that the signal magnitude S is below the first determination threshold TH1 after the ending time point of the blind time period Time_B (i.e. a logical expression would be "S<TH1 && Time_C>Time_B"), the sensor SR would be transitioned back to the stable state S0 in a state transition direction T10. On the other hand, while the sensor SR is in the false alarm state S1 temporarily, when the processor 130 determines that the signal magnitude S exceeds the first determination threshold TH2 or the signal magnitude S is not below the first determination threshold TH1 after the ending time of the detection delay time period Time_D (i.e. a logical expression would be "S>TH2||(TH1<S<TH2 && Time_C>Time_D"), the sensor SR would be transitioned to the alarm state S2 in a state transition direction T12.

It should be noted that, in another one of exemplary embodiments, while the sensor SR is in the stable state S0, when the processor 130 determines that the signal magnitude S falls between the first determination threshold TH1 and the second determination threshold TH2 and the ending time of the detection delay time period Time_D has not been reached, the sensor SR would not be transitioned to the false alarm state S1. Instead, the processor 130 would transition the sensor SR from the stable state to the false alarm state S in the state transition direction T01 when determining that the signal magnitude S drops back to below the first determination threshold TH1 in the detection delay time period. When the processor 130 determines that a consecutive time of the signal magnitude S falling between the first determination threshold TH1 and the second determination threshold TH2 exceeds the ending time of the detection delay time period Time_D, it would transition the sensor SR from the stable state S0 directly to an alarm state S2 in a state transition direction T02.

While the sensor SR is in the stable state S0, when the processor 130 determines that signal magnitude S exceeds the second determination threshold TH2 (i.e. a logical expression would be "S>TH2 && Time_C<Time_D"), it would transition the sensor SR to the alarm state S2 in a state transition direction T02. Similarly, when the processor 130 further determines that the signal magnitude S is below the first determination threshold TH1 after the ending time of the blind time period Time_B (i.e. a logical expression would be "S<TH1 && Time_C>Time_B"), the sensor SR would be transitioned back to the stable state S0 in a state transition direction T20.

In another one of exemplary embodiments, the electronic device 100 may be connected to another sensor and adjust the original thresholds based on a sensor signal or ambient parameters detected thereby. For example, the fluctuation of ambient temperature could affect the signal magnitude. When the temperature is higher, a radiation magnitude measured by an IR sensor would tend to be higher. In such case, its thresholds would be adjusted to be higher to prevent from the sensor being easily triggered and causing false alarms. To be specific, FIG. 7 illustrates a block schematic diagram of an electronic device in accordance with another one of exemplary embodiments in the disclosure.

Figure 7:
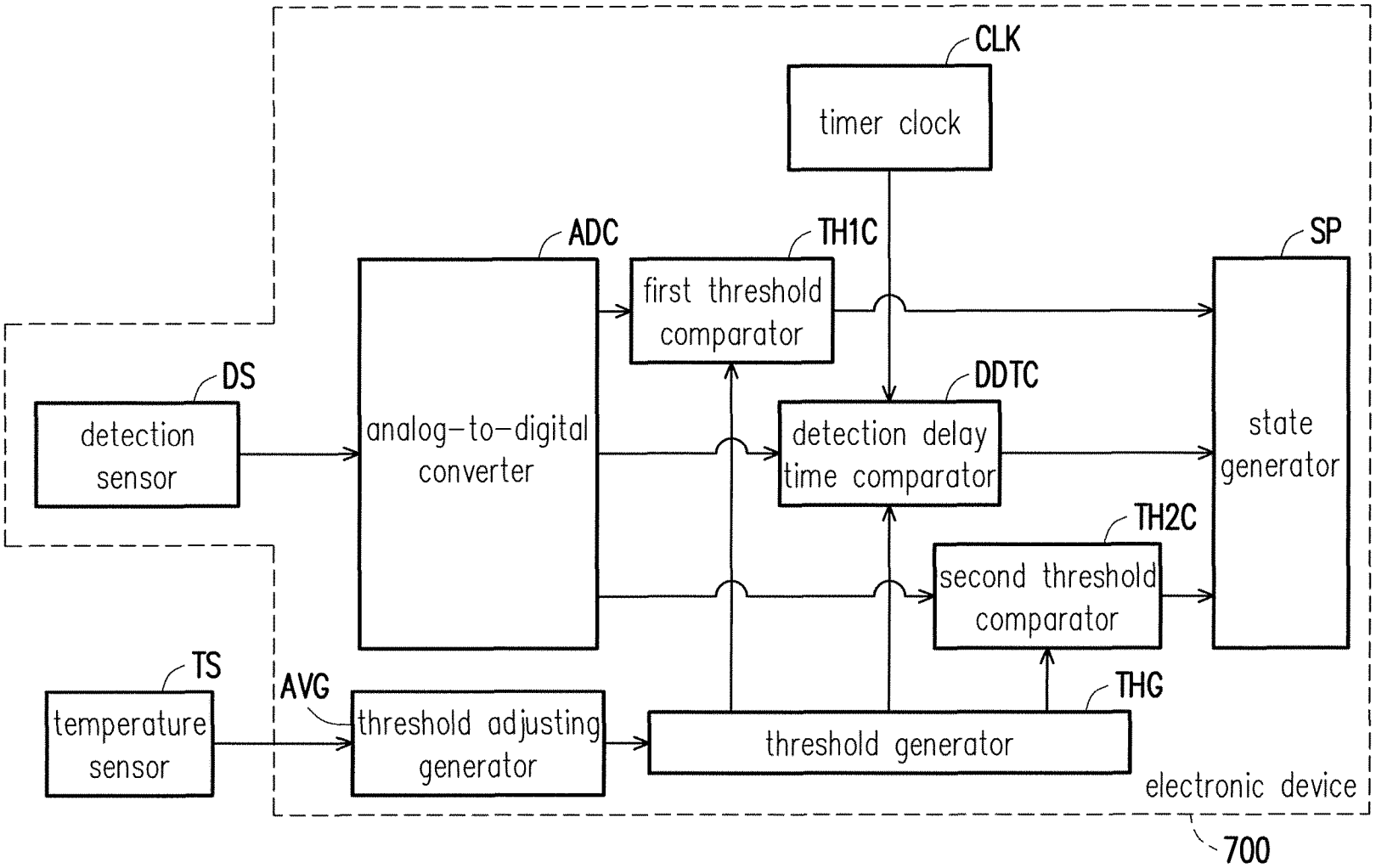
FIG. 7 illustrates a block schematic diagram of an electronic device in accordance with another one of exemplary embodiments in the disclosure.

Referring to FIG. 7, the electronic device 700 would be coupled to a temperature sensor TS and pre-store a first determination threshold, a second determination threshold, and a time determination threshold in a memory (not shown). An analog-to-digital converter ADC of the electronic device 700 would receive and convert a sensor signal of a detection sensor DS to a signal magnitude. A threshold adjusting generator AVG of the electronic device 700 would receive ambient temperature detected by the temperature sensor TS, generate and transmit a threshold adjusting value to a threshold generator THG. The threshold generator THG would adjust at least one of the first determination threshold, the second determination threshold, and the time determination threshold based on the threshold adjusting value. Next, a first threshold comparator TH1C and a second threshold comparator TH2C would compare the signal magnitude received from the analog-to-digital converter ADC with the adjusted first determination threshold and the adjusted second determination threshold, and the detection delay time comparator DDTC would compare a consecutive time of the signal magnitude with the time determination threshold based on a timer clock CLK. Next, comparison results would be transmitted to a state processor SP to perform the state determination flow in associated with a detection sensor DS as illustrated in the previous exemplary embodiments. The detection sensor DS and the analog-to-digital converter ADC would be respectively similar to the sensor SR and the analog-to-digital converter 110 as illustrated in FIG. 1. The threshold adjusting generator AVG, the threshold generator THG, the first threshold comparator TH1C, the second threshold comparator TH2C, the detection delay time comparator DDTC, the timer clock CLK, and the state processor SP may be implemented by modules or circuits that are similar to the processor 130 as illustrated in FIG. 1. Detailed descriptions may not be repeated herein for brevity purposes.

In view of the aforementioned descriptions, the alarm triggering method and the electronic device using the same proposed in the disclosure use multiple thresholds to determine whether a signal magnitude of a sensor signal satisfies an alarm triggering condition so as to reduce chances of false alarms. Moreover, the disclosure would adaptively adjust thresholds based on different ambient conditions and different detected objects so as to trigger alarms in a more precise fashion.

No element, act, or instruction used in the detailed description of disclosed embodiments of the present application should be construed as absolutely critical or essential to the present disclosure unless explicitly described as such. Also, as used herein, each of the indefinite articles "a" and "an" could include more than one item. If only one item is intended, the terms "a single" or similar languages would be used. Furthermore, the terms "any of" followed by a listing of a plurality of items and/or a plurality of categories of items, as used herein, are intended to include "any of", "any combination of", "any multiple of", and/or "any combination of multiples of the items and/or the categories of items, individually or in conjunction with other items and/or other categories of items. Further, as used herein, the term "set" is intended to include any number of items, including zero. Further, as used herein, the term "number" is intended to include any number, including zero.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An alarm triggering method for a sensor comprising steps of:

receiving a sensor signal from the sensor;

determining whether a signal magnitude of the sensor signal satisfies a first triggering condition by comparing the signal magnitude of the sensor signal with a first determination threshold;

when the signal magnitude satisfies the first triggering condition, determining whether the signal magnitude satisfies a second triggering condition according to a second determination threshold and determining whether the signal magnitude satisfies a third triggering condition according to a time determination threshold, wherein the second determination threshold is greater than the first determination threshold;

when the signal magnitude satisfies one of the second triggering condition and the third triggering condition, determining that the sensor is in an alarm state so as to output an alarm signal; and when the signal magnitude does not satisfy the second triggering condition and the third triggering condition, determining that the sensor is in a false-alarm state.

2. The method according to claim 1, wherein the step of determining whether the signal magnitude of the sensor signal satisfies the first triggering condition by comparing the signal magnitude of the sensor signal with the first determination threshold comprises:

determining whether the signal magnitude exceeds the first determination threshold; and when the signal magnitude exceeds the first determination threshold, determining that the signal magnitude satisfies the first triggering condition.

3. The method according to claim 2 further comprising a step of:

when the signal magnitude does not exceed the first determination threshold, determining that the sensor is in a stable state.

4. The method according to claim 2, wherein when the signal magnitude satisfies the first triggering condition, the step of determining whether the signal magnitude satisfies the second triggering condition according to a second determination threshold comprises:

determining whether the signal magnitude exceeds the second determination threshold; and when the signal magnitude exceeds the second determination threshold, determining that the signal magnitude satisfies the second triggering condition and accordingly determining that the sensor is in the alarm state.

5. The method according to claim 4, wherein when the sensor is in the alarm state, the method further comprises a step of:

when the signal magnitude is below the first determination threshold after a blind time period, transitioning the sensor to a stable state.

6. The method according to claim 4, wherein then the signal magnitude satisfies the first triggering condition, the step of determining whether the signal magnitude satisfies the third triggering condition according to the time determination threshold comprises:

when the signal magnitude does not exceed the second determination threshold, determining whether a consecutive time of the signal magnitude being greater than the first determination threshold exceeds the time determination threshold; and when the consecutive time of the signal magnitude being greater than the first determination threshold exceeds the time determination threshold, determining that the signal magnitude satisfies the third triggering condition and accordingly determining that the sensor is in the alarm state.

7. The method according to claim 6 further comprising a step of:

when the consecutive time of the signal magnitude being greater than the first determination threshold does not exceed the time determination threshold, determining that the sensor is in the false-alarm state.

8. The method according to claim 7, wherein when the sensor is in the false-alarm state, the method further comprises a step of:

when the signal magnitude is below the first determination threshold after a blind time period, transitioning the sensor to a stable state.

9. The method according to claim 1 further comprising steps of:

receiving another sensor signal from another sensor; and adjusting at least one of the first determination threshold, the second determination threshold, and the time determination threshold according to a signal magnitude of the another sensor signal.

10. The method according to claim 9, wherein the another sensor is an ambient temperature sensor, and wherein the signal magnitude of the another sensor signal is an ambient temperature value.

11. An electronic device comprising:

a sensor;

an analog-to-digital converter, coupled to the sensor, and configured to receive a sensor signal from the sensor and convert the sensor signal to a signal magnitude;

a memory, configured to store data; and a processor, coupled to the analog-to-digital converter and the memory, and configured to:

determine whether a signal magnitude of the sensor signal satisfies a first triggering condition by comparing the signal magnitude of the sensor signal with a first determination threshold;

when the signal magnitude satisfies the first triggering condition, determine whether the signal magnitude satisfies a second triggering condition according to a second determination threshold and determining whether the signal magnitude satisfies a third triggering condition according to a time determination threshold, wherein the second determination threshold is greater than the first determination threshold;

when the signal magnitude satisfies one of the second triggering condition and the third triggering condition, determine that the sensor is in an alarm state so as to output an alarm signal; and when the signal magnitude does not satisfy the second triggering condition and the third triggering condition, determining that the sensor is in a false-alarm state.

12. The electronic device according to claim 11, wherein the processor is further configured to:

determine whether the signal magnitude exceeds the first determination threshold; and when the signal magnitude exceeds the first determination threshold, determine that the signal magnitude satisfies the first triggering condition.

13. The electronic device according to claim 12, wherein the processor is further configured to:

when the signal magnitude does not exceed the first determination threshold, determine that the sensor is in a stable state.

14. The electronic device according to claim 12, wherein when the signal magnitude satisfies the first triggering condition, the processor is configured to:

determine whether the signal magnitude exceeds the second determination threshold; and when the signal magnitude exceeds the second determination threshold, determine that the signal magnitude satisfies the second triggering condition and accordingly determining that the sensor is in the alarm state.

15. The electronic device according to claim 14, wherein when the sensor is in the alarm state, the processor is further configured to:

when the signal magnitude is below the first determination threshold after a blind time period, transition the sensor to a stable state.

16. The electronic device according to claim 14, wherein then the signal magnitude satisfies the first triggering condition, the processor is configured to:

when the signal magnitude does not exceed the second determination threshold, determine whether a consecutive time of the signal magnitude being greater than the first determination threshold exceeds the time determination threshold; and when the consecutive time of the signal magnitude being greater than the first determination threshold exceeds the time determination threshold, determine that the signal magnitude satisfies the third triggering condition and accordingly determine that the sensor is in the alarm state.

17. The electronic device according to claim 16, wherein the processor is further configured to:

when the consecutive time of the signal magnitude being greater than the first determination threshold does not exceed the time determination threshold, determine that the sensor is in the false-alarm state.

18. The electronic device according to claim 17, wherein when the sensor is in the false-alarm state, the processor is further configured to:

when the signal magnitude is below the first determination threshold after a blind time period, transition the sensor to a stable state.

19. The electronic device according to claim 11 further comprising another sensor, and wherein the processor is further configured to:

receive another sensor signal from another sensor; and adjust at least one of the first determination threshold, the second determination threshold, and the time determination threshold according to a signal magnitude of the another sensor signal.

20. The electronic device according to claim 19, wherein the another sensor is an ambient temperature sensor, and wherein the signal magnitude of the another sensor signal is an ambient temperature value.

21. The electronic device according to claim 11, adaptive to be used with another sensor, and wherein the processor is further configured to:

receive another sensor signal from the another sensor; and adjust at least one of the first determination threshold, the second determination threshold, and the time determination threshold according to a signal magnitude of the another sensor signal.

22. The electronic device according to claim 21, wherein the another sensor is an ambient temperature sensor, and wherein the signal magnitude of the another sensor signal is an ambient temperature value.

* * * * *